US008485705B2

(12) United States Patent
Boroczki et al.

(10) Patent No.: US 8,485,705 B2
(45) Date of Patent: Jul. 16, 2013

(54) PROJECTOR TYPE HEADLAMP OF MAXIMIZED LIGHT COLLECTING EFFICIENCY

(75) Inventors: Agoston Boroczki, Budapest (HU); Istvan Csanyi, Pest (HU); Csaba Horvath, Budapest (HU); Tamas Panyik, Budapest (HU)

(73) Assignee: General Electric Company, Schenectady, NY (US)

( * ) Notice: Subject to any disclaimer, the term of this patent is extended or adjusted under 35 U.S.C. 154(b) by 74 days.

(21) Appl. No.: 13/005,862

(22) Filed: Jan. 13, 2011

(65) Prior Publication Data

US 2012/0182752 A1 Jul. 19, 2012

(51) Int. Cl.
*F21V 17/02* (2006.01)

(52) U.S. Cl.
USPC ..... 362/512; 362/509; 362/517; 362/538; 362/539

(58) Field of Classification Search
USPC ..... 362/507, 509, 516, 517, 518, 538, 362/539
See application file for complete search history.

(56) References Cited

U.S. PATENT DOCUMENTS

| | | | | |
|---|---|---|---|---|
| 1,775,619 | A * | 9/1930 | Whalen | 362/302 |
| 4,800,467 | A * | 1/1989 | Lindae et al. | 362/539 |
| 5,938,323 | A * | 8/1999 | McMahan | 362/539 |
| 6,536,918 | B1 * | 3/2003 | Boroczki et al. | 362/263 |
| 7,093,966 | B2 | 8/2006 | Yamamura et al. | |
| 7,121,704 | B2 * | 10/2006 | Takada | 362/516 |
| 2003/0128550 | A1 | 7/2003 | Ui | |
| 2004/0174713 | A1 * | 9/2004 | Garcia et al. | 362/517 |
| 2006/0023465 | A1 | 2/2006 | Ohshio et al. | |
| 2009/0251915 | A1 | 10/2009 | Boroczki et al. | |

FOREIGN PATENT DOCUMENTS

| | | | |
|---|---|---|---|
| EP | 0942224 | A1 | 9/1999 |
| EP | 1694078 | A1 | 8/2006 |
| FR | 2860060 | A1 | 3/2005 |
| GB | 334803 | A | 9/1930 |
| JP | H01-126005 | U | 8/1989 |
| JP | 2002175709 | A | 6/2002 |
| JP | 2006310048 | A | 11/2006 |
| JP | 2007258000 | A | 10/2007 |
| WO | WO 2007/092124 | A1 | 8/1997 |

OTHER PUBLICATIONS

PCT Invitation to Pay Additional Fees dated Feb. 20, 2012 from corresponding Application. No. PCT/US2011/63468.
PCT Search Report and Written Opinion dated Apr. 12, 2012 from corresponding Application No. PCT/US2011/063468.

* cited by examiner

*Primary Examiner* — Ali Alavi
(74) *Attorney, Agent, or Firm* — Fay Sharpe LLP

(57) ABSTRACT

An improved light collecting efficiency in a projector type automotive headlamp is achieved by including a curved mirror to re-direct light otherwise absorbed by a rear surface of the blocking cut-off shield in "low beam" operating mode of the headlamp. When the shield is moved to a second non-blocking position, a mirror segment conforms to the curved surface of the substantially ellipsoidal reflector to maximize lumen output in "high beam" operating mode of the headlamp. In addition, auxiliary mirror segments may be used to provide a more complete substantially ellipsoidal reflector configuration that maximizes the light collection efficiency. Preferably, the cap holder is purposefully offset in order to position the centerline of the bowed arc of the arc discharge light source in alignment with the optical axis of the optical system in order to maximize light collection efficiency.

17 Claims, 10 Drawing Sheets

PROJECTOR TYPE HEADLAMP OF MAXIMIZED LIGHT COLLECTING EFFICIENCY

BACKGROUND OF THE DISCLOSURE

This disclosure relates to a vehicle headlamp system, and more particularly to a headlamp system that employs a compact high intensity discharge lamp having at least two different lighting functions or modes (e.g., "high beam" and "low beam" modes) integrated into a single headlamp assembly. Selected aspects of this disclosure may also find application in related headlamp arrangements.

Light collection efficiency of state of the art ellipsoidal projector modules of a projector-type automotive headlamp is moderate. Limitations associated with the light collection efficiency are basically driven by light absorption by the cut-off shield inserted into the module to block unwanted light rays when operated in "low beam" mode. The unwanted light rays in this mode are those that would otherwise be directed by the headlamp toward the eyes of an oncoming driver approaching the vehicle from the opposite direction. The cut-off shield defines a sharp light-to-dark cut-off in the headlamp beam. The cut-off line produced by the light blocking cut-off shield is preferably a straight, substantially horizontal line in the lanes of oncoming traffic. Further, the cut-off line is a skewed straight line in the lanes of the driver having the headlamp installed in his vehicle. In other words, beam cut-off is a means to avoid glare to oncoming drivers and partly to avoid glare for drivers moving in front of or close to the vehicle when in a "low beam" mode of the headlights. The beam cut-off also allows lighting of the road edge in the driving direction so that, for example, roadway signs are illuminated by the headlamp in the "low beam" mode.

Light collecting efficiency of a projector module can be increased by making an ellipsoidal projector module more compact and with a smaller opening area for the projector lens. Unfortunately, this proposed solution also has drawbacks. For example, the small surface area of the projector lens means higher surface brightness, which can cause discomfort glare to oncoming drivers. Accordingly, a diameter of the lens is thus preferably limited to be not less than approximately 60 millimeters minimum, since the glare can be uncomfortable or disturbing with lenses of diameters as low as less than 60 millimeters. Consequently, a new ellipsoidal projector module construction that eliminates, or at least reduces, light losses due to cut-off shield absorption and other loss mechanisms in the projector modules could have an advantageous impact in headlamp design technology.

SUMMARY OF THE DISCLOSURE

An automotive headlamp includes a light source and a light reflecting surface or "reflector" that receives light from the light source and directs the light toward a lens. A curved mirror is interposed between the light source and the lens for re-directing a portion of the light heading originally toward the lens back toward the reflector.

A shield is movable between first and second positions, and in the first or blocking position, the shield selectively blocks a portion of the light from the light source from passing through the shield, and the shield supports the curved mirror.

In a second position of the shield, an opening in the reflector receives the curved mirror.

The shield preferably includes an additional curved mirror segment for conforming to the curved surface of the reflector in the second position of the shield.

In a preferred arrangement, the reflector is a truncated substantially ellipsoidal surface, and the light source is located at a first focal point of the reflector. The shield is preferably located between the first focal point and a second focal point of the substantially ellipsoidal reflector.

Auxiliary mirror segments extend from the truncated substantially ellipsoidal reflector and direct light from the light source toward the first focal point or toward the second focal point of the reflector.

In one arrangement, the light source is an arc discharge lamp and is purposefully offset from the first focal point of a substantially ellipsoidal reflector by a predetermined dimension.

A central optical axis of the arc discharge light source is preferably positioned in parallel and vertically offset below a horizontal longitudinal optical axis of the substantially ellipsoidal reflector, and an adjustment member may also be provided for selectively altering the offset of the arc discharge light source from the first focal point.

The curved mirror is purposefully imperfect so that redirected light rays do not overheat the light source in one arrangement.

A primary benefit is the improved light collection efficiency of a projector type automotive headlamp, and significant increase of beam intensity in the "low beam" mode of operation.

Improved positioning accuracy can also be achieved by a lamp fixation method in an automotive headlamp.

By virtue of increased light collection efficiency, the total lumen output, road illuminance levels and projected beam angle of the projector type automotive headlamp can be increased using teachings of the present disclosure.

Another benefit is enhanced visibility on the road, or the ability to use a light source with a lower power consumption which, in turn, can lead to better fuel efficiency of a vehicle.

Still another advantage relates to enhancing light collection efficiency by the use of auxiliary mirrors and mirror segments rather than altering the overall dimensions of the projector module.

Still other benefits and advantages of the present disclosure will become more apparent upon reading and understanding the following detailed description.

DETAILED DESCRIPTION OF THE PREFERRED EMBODIMENTS

Figure 2:
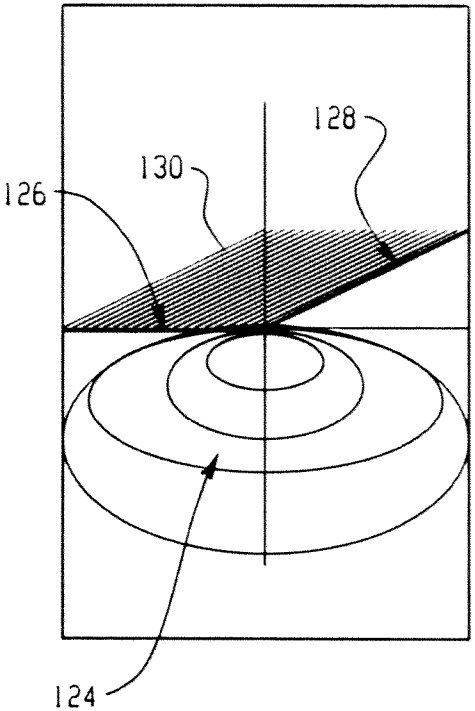
Fig. 2 PRIOR ART
FIG. 2 shows the illuminated region ahead of a vehicle in a "low beam" mode with the headlamp system of FIG. 1.
Figure 1:
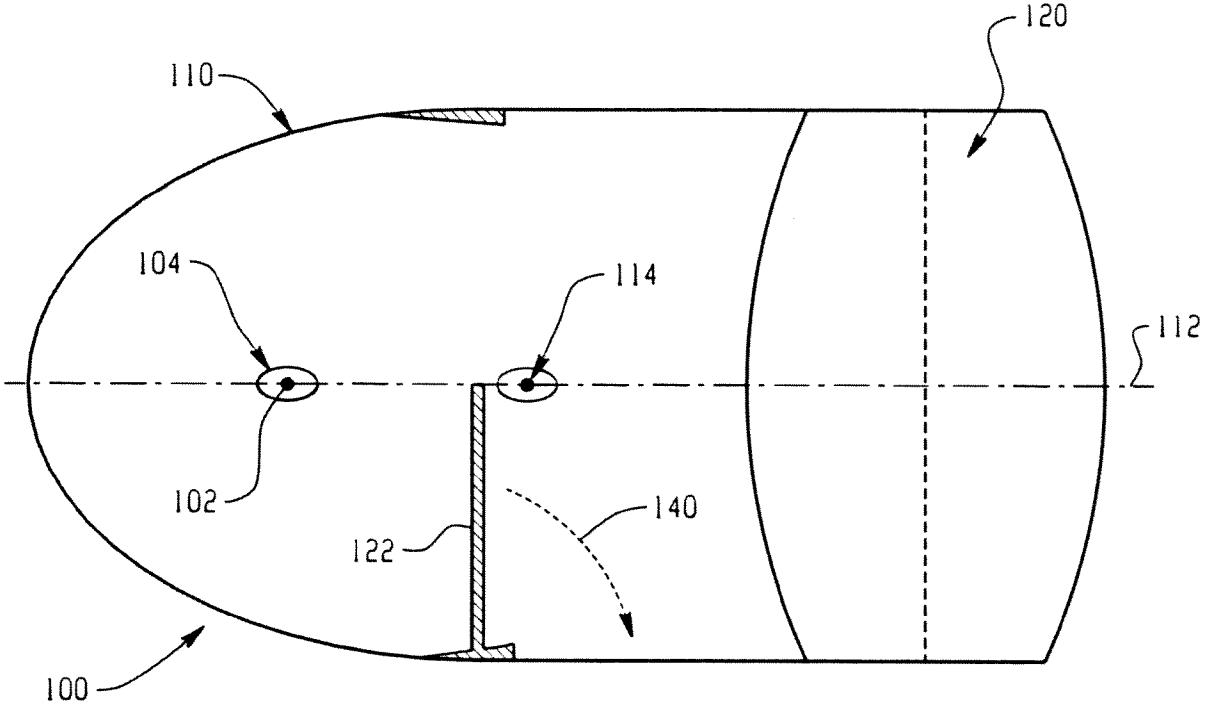
Fig. 1 PRIOR ART
FIG. 1 is a longitudinal, cross-sectional schematic representation of a prior art arrangement of a projector type automotive headlamp system.
Figure 3:
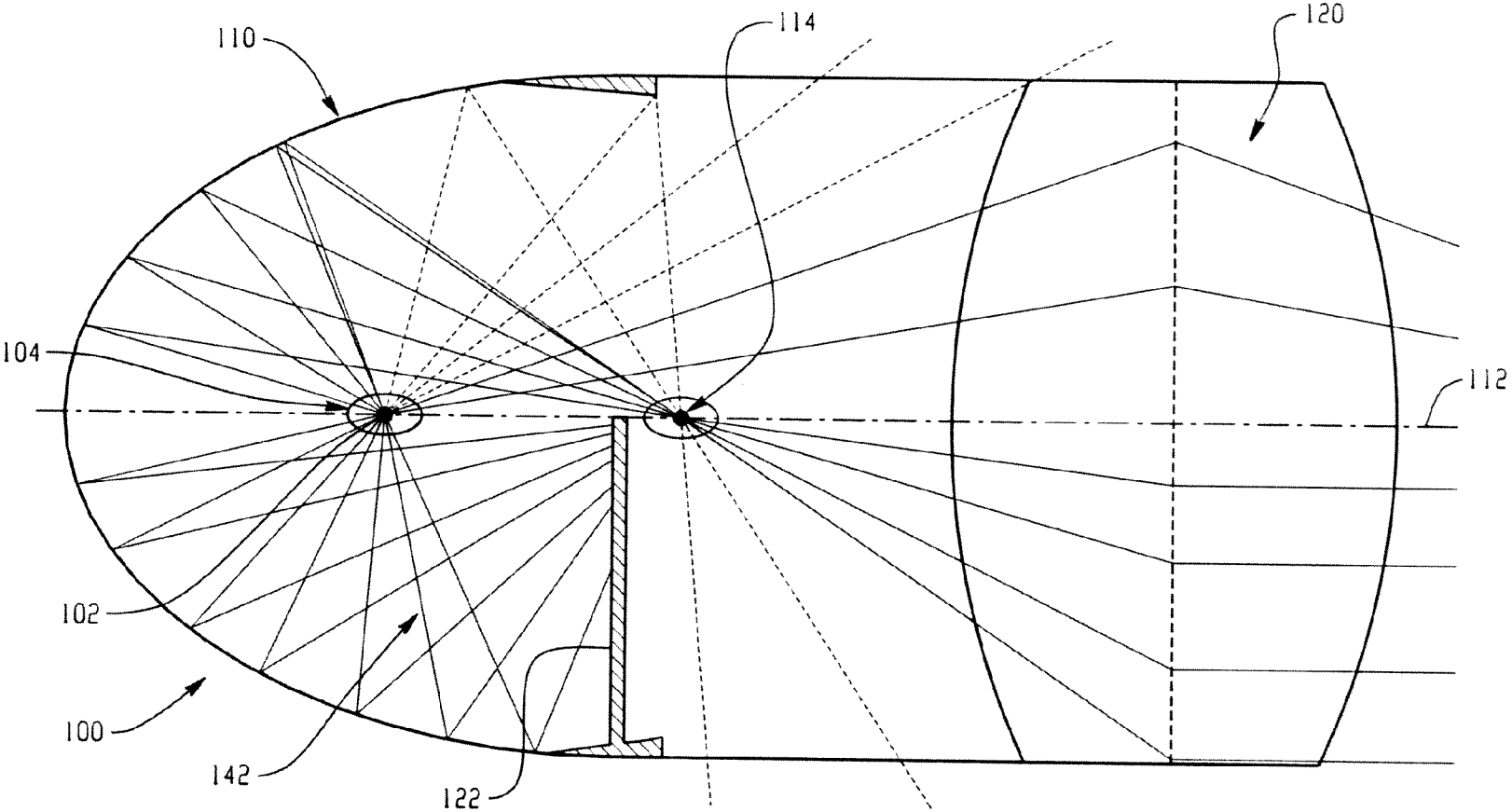
Fig. 3 PRIOR ART
FIG. 3 shows the "low beam" mode in the prior art projector type headlamp of FIG. 1 with light ray traces.

Turning first to FIGS. 1-3, a current projector type automotive headlamp 100 includes a light source such as arc discharge light source 102 located at a first focal point 104 of a substantially ellipsoidal light reflecting surface or reflector 110. As shown in the longitudinal cross-sectional view, the reflector has a substantially ellipsoidal surface about a longitudinal optical axis 112 that includes the first focal point 104 and a second focal point 114. The substantially ellipsoidal reflector may be truncated, or may be a more complete surface, however at least a portion of the reflector includes the substantially ellipsoidal surface portion. The substantially ellipsoidal reflector 110 receives light from light source 102 and directs the light toward lens 120 which is a part of the projector module or headlamp assembly (FIG. 3).

More particularly, since the light source 102 is located at the first focal point 104 of the substantially ellipsoidal reflector, light is directed toward the image of the light source formed at the second focal point 114, passes through the second focal point, and continues through the headlamp assembly toward the lens 120. The lens transmits and orients the light rays in a desired direction from the front of the vehicle and illuminates the road ahead of the vehicle, i.e., in a forward direction. In a "low beam" mode of operation, a portion of the light emitted from the light source is blocked that would otherwise be directed toward the lens, or more specifically toward the second focal point (FIG. 3). The light is blocked by a shield 122 that is preferably situated between the first and second focal points of the substantially ellipsoidal reflector. As perhaps best evident in FIG. 2, light transmitted to illuminate an area on road surface 124 ahead of the vehicle is generally not blocked by the shield 122. Instead, the shield provides a substantially horizontal cut-off line 126 in the lanes of oncoming traffic, and the cut-off line angles upwardly, as represented by reference numeral 128, on the driver's side of the vehicle to also illuminate roadside signs or the like along the edge of the road. The well-defined light-to-dark cut-off lines 126, 128 also define a dark zone 130 that is formed above the cut-off lines so that glare light is not directed to oncoming traffic.

In FIG. 1, the shield 122 is shown in a first or blocking position where the light rays launched toward the shield are shown to be blocked ("low beam" mode). In an alternative arrangement ("high beam" mode), the shield 122, as shown by reference numeral 140, can proceed to a second or non-blocking position allowing the formerly blocked light rays to pass through and thus to contribute light to the otherwise dark region 130 formed by the cut-off lines as was a result of the shield in the blocking position. That is, the cut-off lines 126, 128 would be removed in "high beam" mode, and a portion of the forward light transmitted and otherwise absorbed by the rear surface of the shield 122 would be projected forwardly of the vehicle. Thus, those light rays represented by reference numeral 142 in FIG. 3 represent light loss by cut-off shield absorption in the prior art arrangement.

Figure 4:
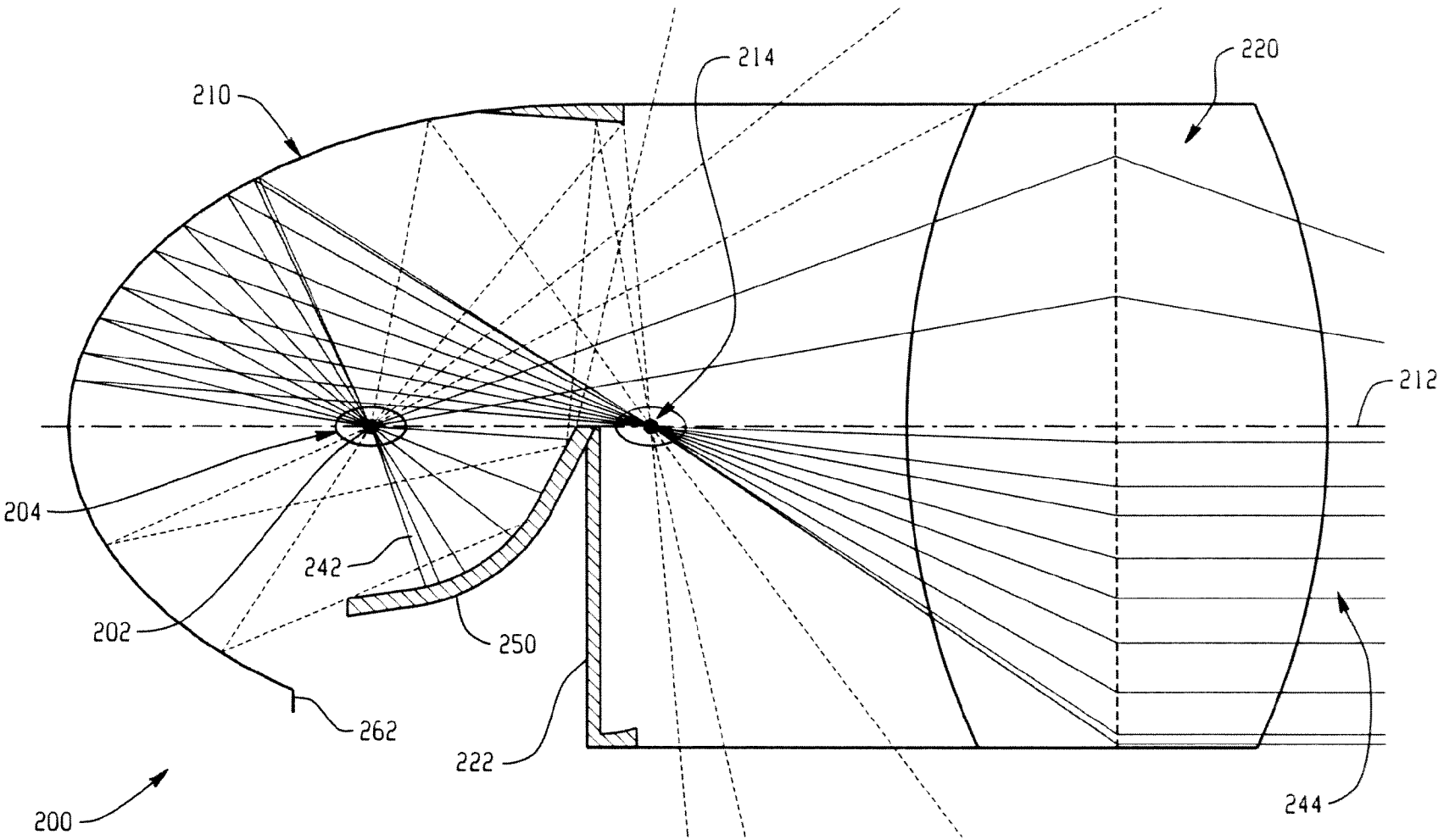
FIG. 4 is a view similar to FIG. 3 and showing a modified "low beam" mode elliptical module with increased light collecting efficiency of a projector-type headlamp with a curved mirror segment mounted on a rear surface of a shield that is in a first, blocking position.

FIG. 4 shows a preferred embodiment of a modified elliptical module of a projector type headlamp assembly 200. For purposes of consistency and brevity, like components will be referenced by like reference numerals in the 200 series. Thus, a light source such as an arc discharge light source 202 is similarly located at a first focal point 204 of substantially ellipsoidal reflector 210. It will also be recognized by one skilled in the art that instead of an arc discharge light source, other light sources may be potentially used with the headlamp assembly such as an incandescent light source or halogen arrangement. Nevertheless, it is preferable that the light source be located substantially at the first focal point 204 of the substantially ellipsoidal reflector so that light directed outwardly from the light source toward the reflector is directed by the substantially ellipsoidal reflector surface toward the second focal point 214. At the second focal point of the substantially ellipsoidal reflector, an image of the light source located at the first focal point is formed, and the light rays continue toward lens 220. The lens 220 bends or directs the light rays in a desired pattern to illuminate the road in front of the vehicle. Thus, when shield 222 is situated in the first blocking position shown in FIG. 4, the light beam projected forwardly from the lens still has a relatively sharp cut-off region but the total light output of the headlamp is increased because of the inclusion of curved mirror 250. The increased brightness of the headlamp in the "low beam" mode is evidenced by the increased number of light rays 244 because of the addition of curved mirror 250 mounted to the rear side of the shield. More particularly, the brightness is increased in the region 244 passing through the lower horizontal portion of the lens 220. The shield 222 still bocks and forms the horizontal and angle cut-off lines to define the dark area or region in front of the vehicle. However, the surface geometry of the curved mirror 250 preferably secured to the shield 222 is contoured to receive light rays otherwise absorbed by the rear surface of the shield, i.e., portion 242, and to reflect this otherwise absorbed light back toward the first focal point of the substantially ellipsoidal reflector 210. In this way, a greater portion of the total light output from the light source located in the vicinity of this same first focal point proceeds finally through the second focal point 214 and reaches the lower portion of lens 220. As noted above, this increased brightness of the automotive headlamp is represented by the increased number of light rays 244 in FIG. 4, and is representative of a gained or extra light intensity. In summary, the curved mirror 250 must be properly shaped to direct the otherwise wasted light toward the first focal point, i.e., back through the light source and toward the substantially ellipsoidal reflector where it is then directed to the second focal point. The edge of the curved mirror 250 coincides with the sharp cut-off line associated with the cut-off shield so that the light intensity passing through the upper horizontal portion of the lens 220 is significantly less and is essentially negligible in intensity than the lower horizontal portion, and still provides for a dark area in the "low beam" mode of operation.

Figure 5:
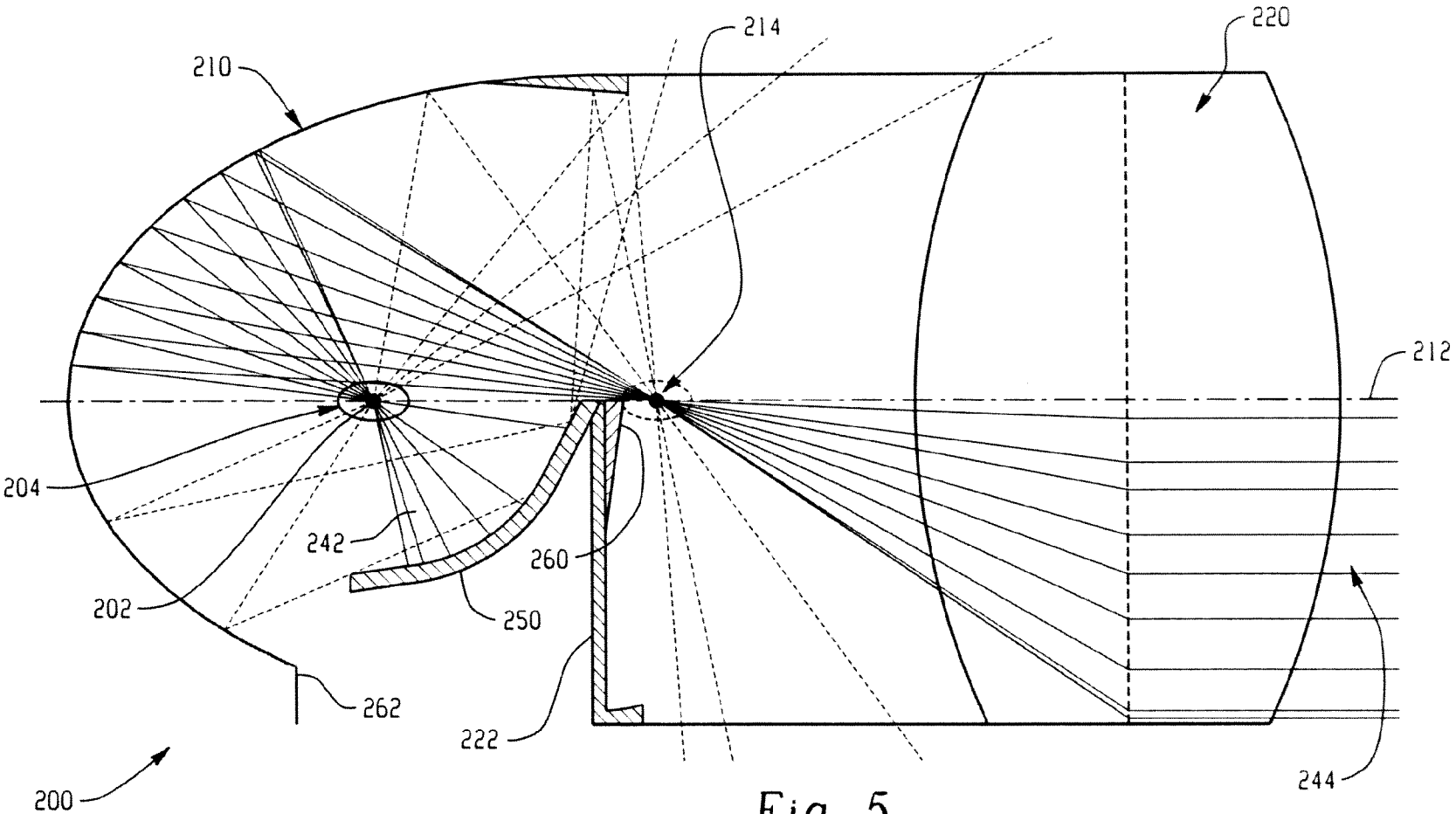
FIG. 5 is a view similar to FIG. 4 with an additional mirror segment provided on the shield front surface.
Figure 6:
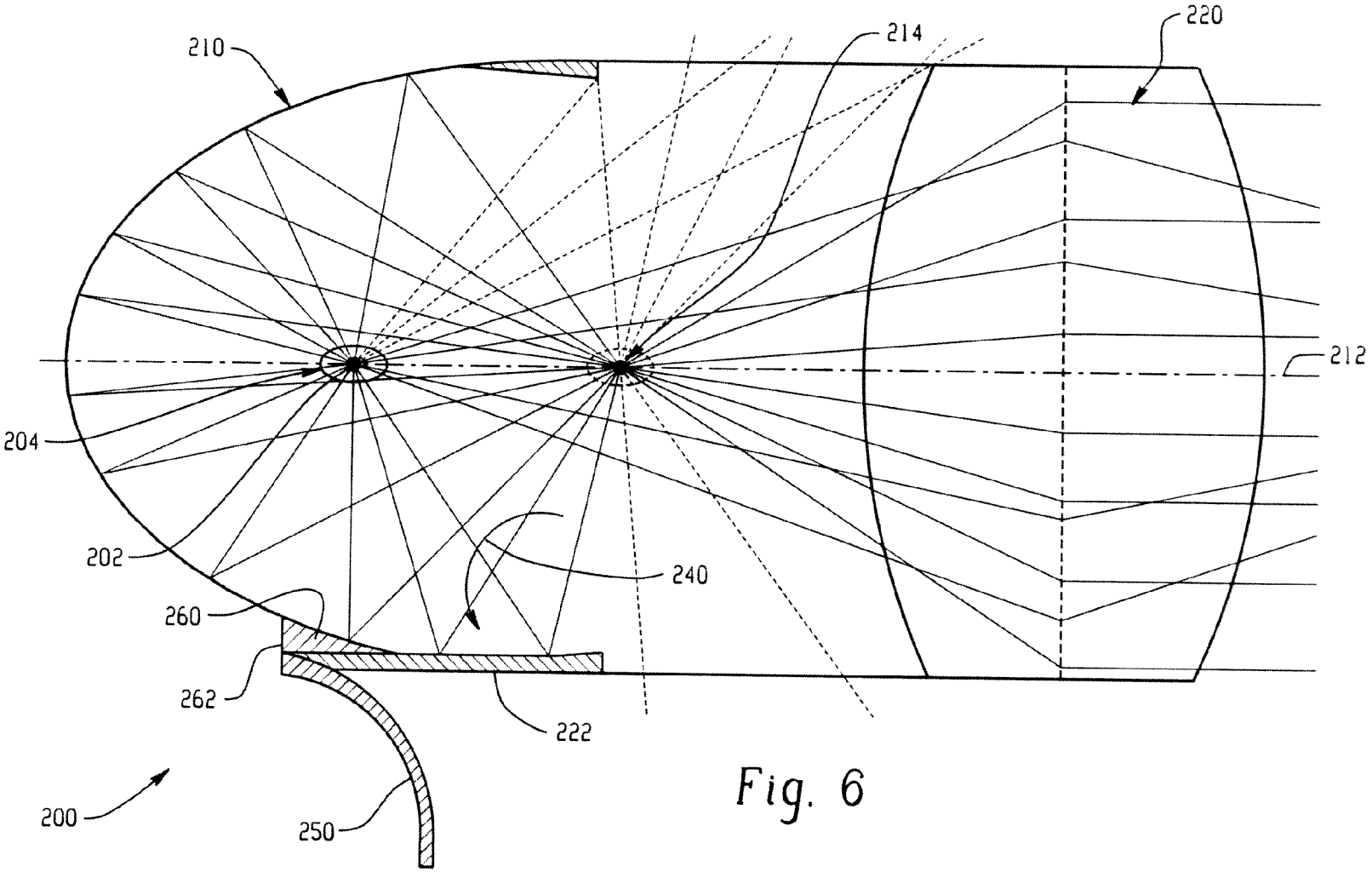
FIG. 6 is a view of the shield in a second position ("high beam" mode of operation) where the additional mirror segment on the shield front surface conforms to the curved surface of the substantially ellipsoidal reflector.

The embodiment of FIGS. 5 and 6 is substantially identical to FIG. 4 so that like reference numerals refer to like components. The primary distinction relates to the inclusion of an additional curved mirror segment 260. The additional curved mirror segment 260 has a substantially ellipsoidal contour similar to the shape of the generally ellipsoidal main mirror 210, perhaps best evidenced in FIG. 6, so that when the shield and accompanying curved mirror 250 are rotated in unison along the direction of reference numeral 240, the additional curved mirror segment forms an extension and merges into the substantially ellipsoidal conformation of the reflector surface 210. That is, an opening 262 is provided in the reflector 210 and the opening is dimensioned to receive the curved mirror 250 therethrough, and is substantially covered by the shield 222. Thus, in the second or non-blocking position of the shield shown in FIG. 6, the additional curved mirror segment 260 completes or merges with the contour of the substantially ellipsoidal reflector 210 so that light from the light source 202 located at the first focal point 204 is also directed toward the second focal point of the generally ellipsoidal main mirror 214 by this additional curved mirror segment 260. Thus, the shield 222 rotates in a direction toward the first focal point (backward), rather than toward the lens (forward) as in the prior art arrangement (FIG. 1). The opening 262 is substantially covered by the shield 222 in the second, non-blocking position. Thus, it will be appreciated that the additional curved mirror segment 260 increases light collection efficiency of the modified automotive headlamp in the "high beam" mode of FIG. 6, while the curved mirror 250 increases the light collection of it in the "low beam" mode of FIG. 5.

Figure 7:
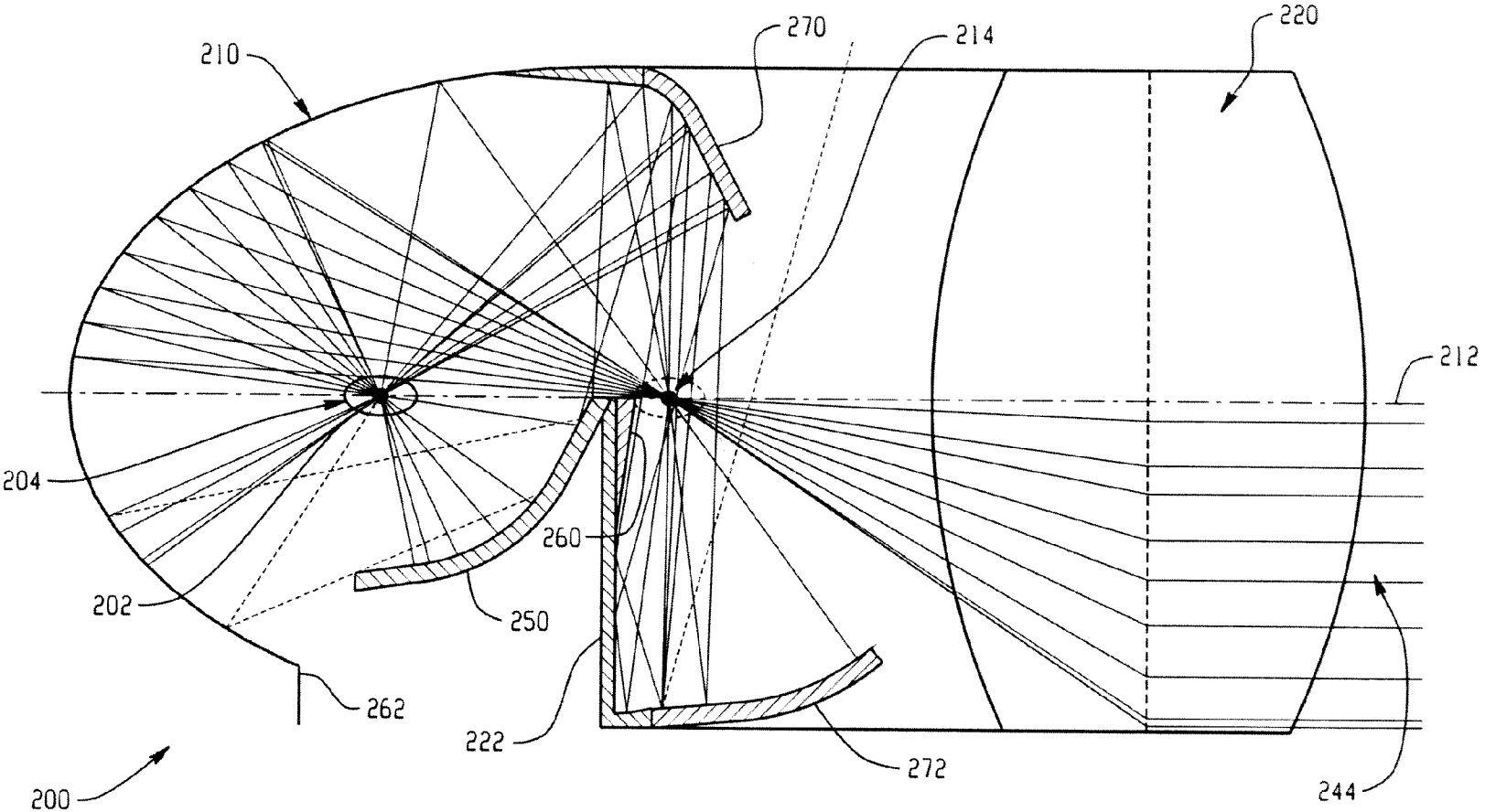
FIG. 7 is a view of the shield in a first position, or "low beam" mode, and incorporating auxiliary mirror segments extending from the substantially ellipsoidal reflector.
Figure 8:
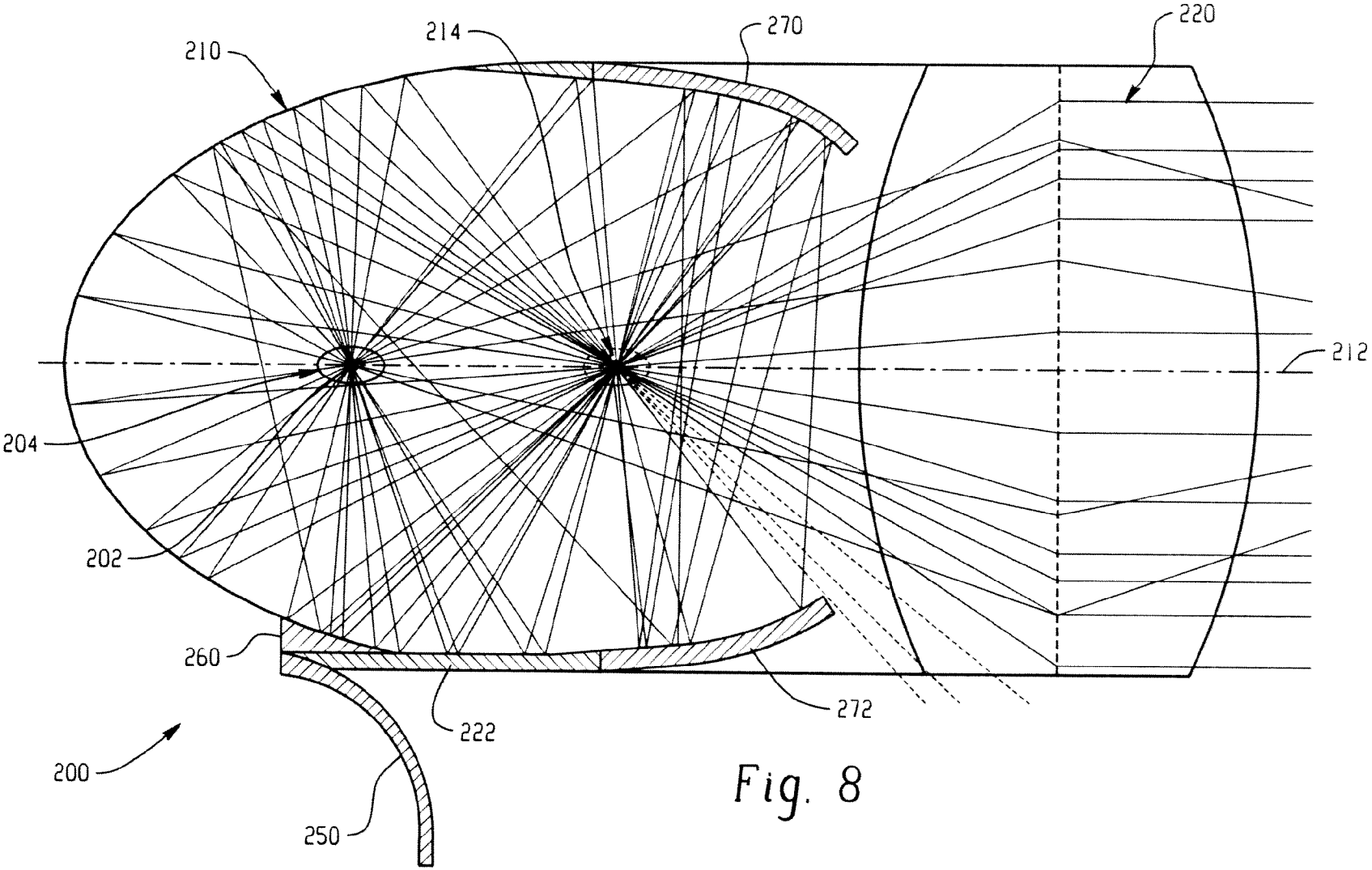
FIG. 8 is a view similar to FIG. 7 with an alternate contour of the auxiliary mirror segments extending from the substantially ellipsoidal reflector for the second position of the shield or "high beam" mode.

The embodiment of FIGS. 7 and 8 includes many of the same features shown in FIGS. 4-6, along with the addition of auxiliary mirror segments 270, 272. In the "low beam" mode of FIG. 7, the first auxiliary mirror segment 270 is bent or contoured to direct light emitted from the light source at the first focal point back toward the light source itself (toward the first focal point 204), rather than permitting the light to proceed toward the lens and thus representing losses of the optical system, not mentioning the low unwanted background illumination created by these light rays in the essentially dark area 130 of the cut-off "low beam". Likewise, auxiliary mirror segment 272 reflects a portion of the light passing through the second focal point back toward the second focal point 214, rather than being released off-side from the optical system of the headlamp and finally being absorbed by surroundings. Thus, in the "low beam" mode of FIG. 7, auxiliary mirror segments 270 and 272 re-direct and recover some light rays otherwise lost from the "low beam" bundle of the ellipsoidal projector module, and thus provide additional contribution to the total efficiency of the modified automotive headlamp.

The shield and curved mirror, which are preferably shown fixed relative to one another, are rotated to cover the opening 262 in the "high beam" mode of FIG. 8. Likewise, the first auxiliary mirror segment 270 adopts an altered contour in this "high beam" mode where the first auxiliary mirror segment 270 undertakes a conformation closer to that of the second auxiliary segment 272 so that the output aperture of the substantially ellipsoidal reflector 210 is increased compared to the "low beam" mode depicted by FIG. 7. This arrangement of the first and second auxiliary segments captures and reflects light from the second focal point 214 back toward the second focal point, where it is ultimately directed back toward the light source. Alternatively and more preferably, both auxiliary mirror segments 270 and 272 may have a geometry so that they allow for an increased output aperture of the generally ellipsoidal main mirror and reflect the light back to the first focal point, that is toward the light source, instead of the second focal point in "high beam" mode of FIG. 8. As a final result of these auxiliary mirror segments, with the shield 222 moved into its second conforming position, shown in FIG. 8, a substantially greater portion of the light output from the light source is collected and optically transmitted to the lens 220 for use in "high beam" mode forward lighting of the vehicle.

Figure 9:
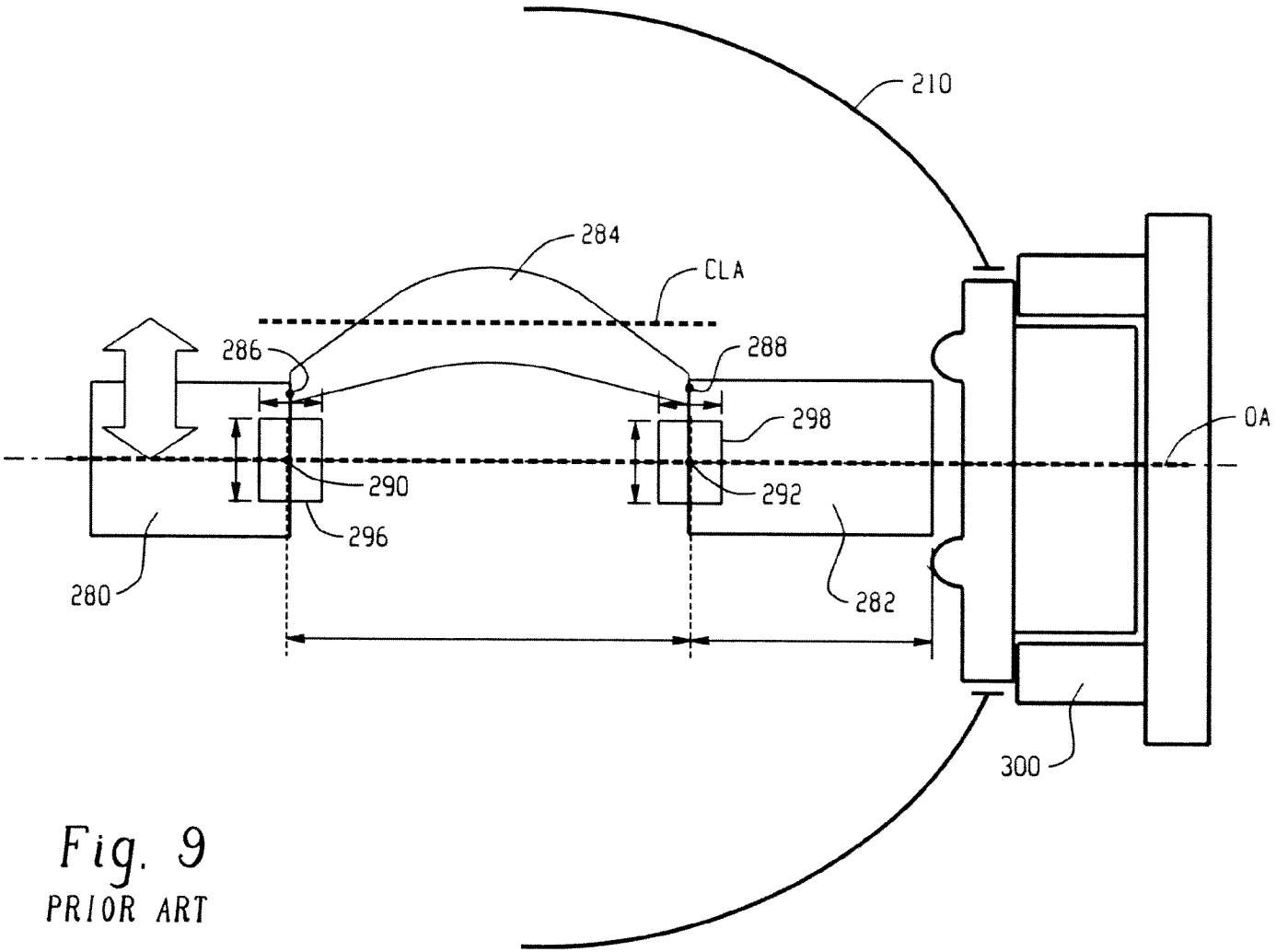
Fig. 9 PRIOR ART
FIG. 9 is a prior art view of the arc alignment of a high intensity discharge lamp associated with the headlamp optics.

In an enlarged schematic representation of FIG. 9, electrodes 280, 282 of the arc discharge light source 202 are schematically illustrated relative to the substantially ellipsoidal reflector 210. The arc discharge 284 extending between the electrodes is shown in an operative position with arc anchor points 286, 288 of the arc located at upper corners of respective electrodes and arc 284 extending in a bowed conformation from the anchor points at either end in case of the standard horizontal operation of the discharge lamp inside the automotive headlamp. This prior art arrangement shows that the anchor points of the arc with the electrodes do not align with center points of a front surface of the electrodes, and thus the centerline CLA of the arc does not coincide with an optical axis OA of the headlamp optics. As a result, there is an optical misalignment between the arc and the optical system of the headlamp which inevitably results in optical losses.

Figure 10:
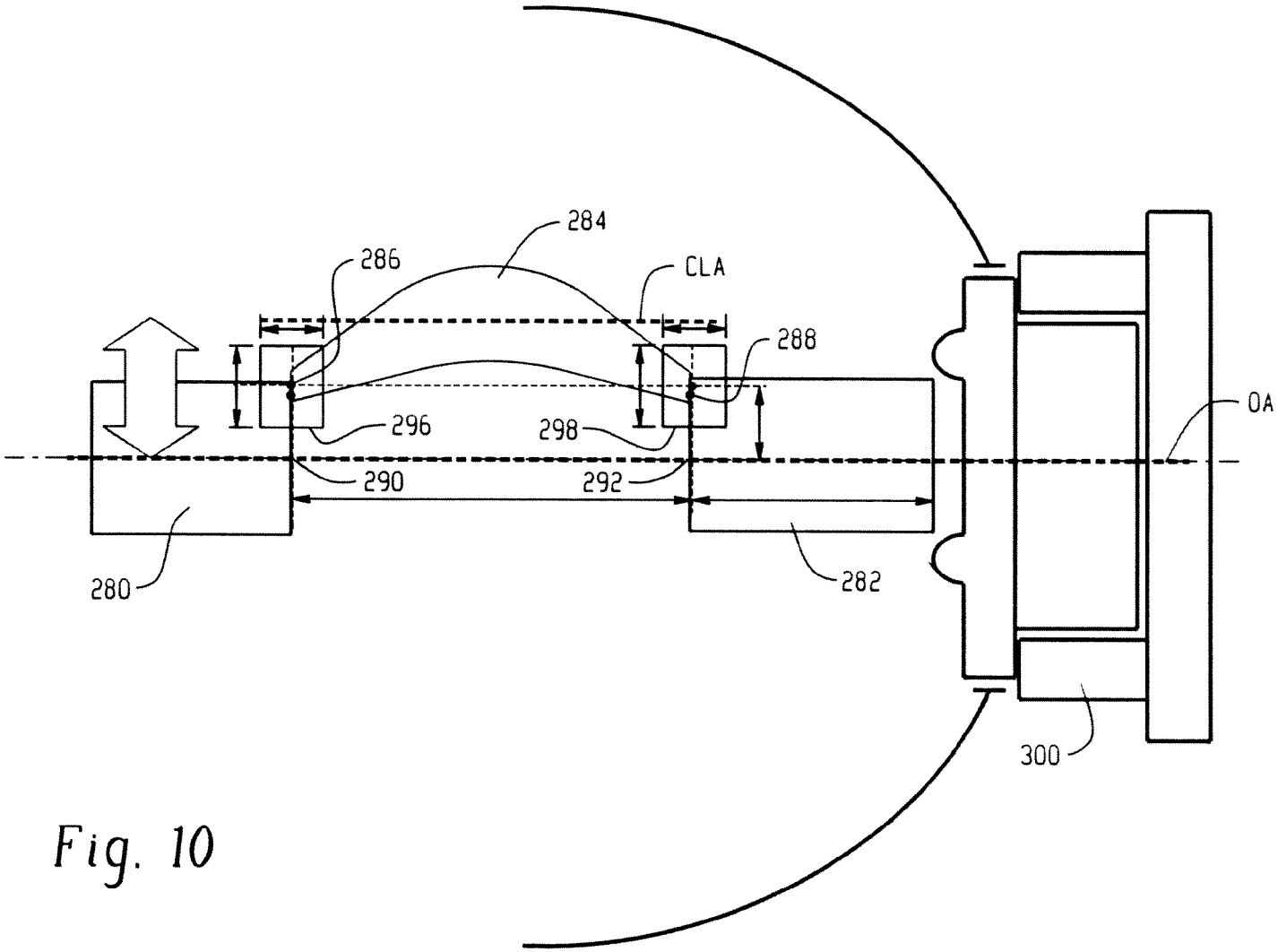
FIG. 10 shows an alternative prior art view for aligning the arc of a high intensity discharge lamp in the headlamp optics.

Electrode optical alignment boxes 296, 298, are shown as being centered on center points 290, 292 of the electrode surfaces in the prior art arrangement of FIG. 9 and are shifted to the arc anchor points 286, 288 in the alternative prior art embodiment of FIG. 10. Thus, even though the arc 284 is still bent and shifted off of the optical axis OA of the headlamp optics, better alignment occurs. Optical losses still occur, though, due to optical misalignment between the arc centerline CLA and optical axis OA of the headlamp optics.

Figure 11:
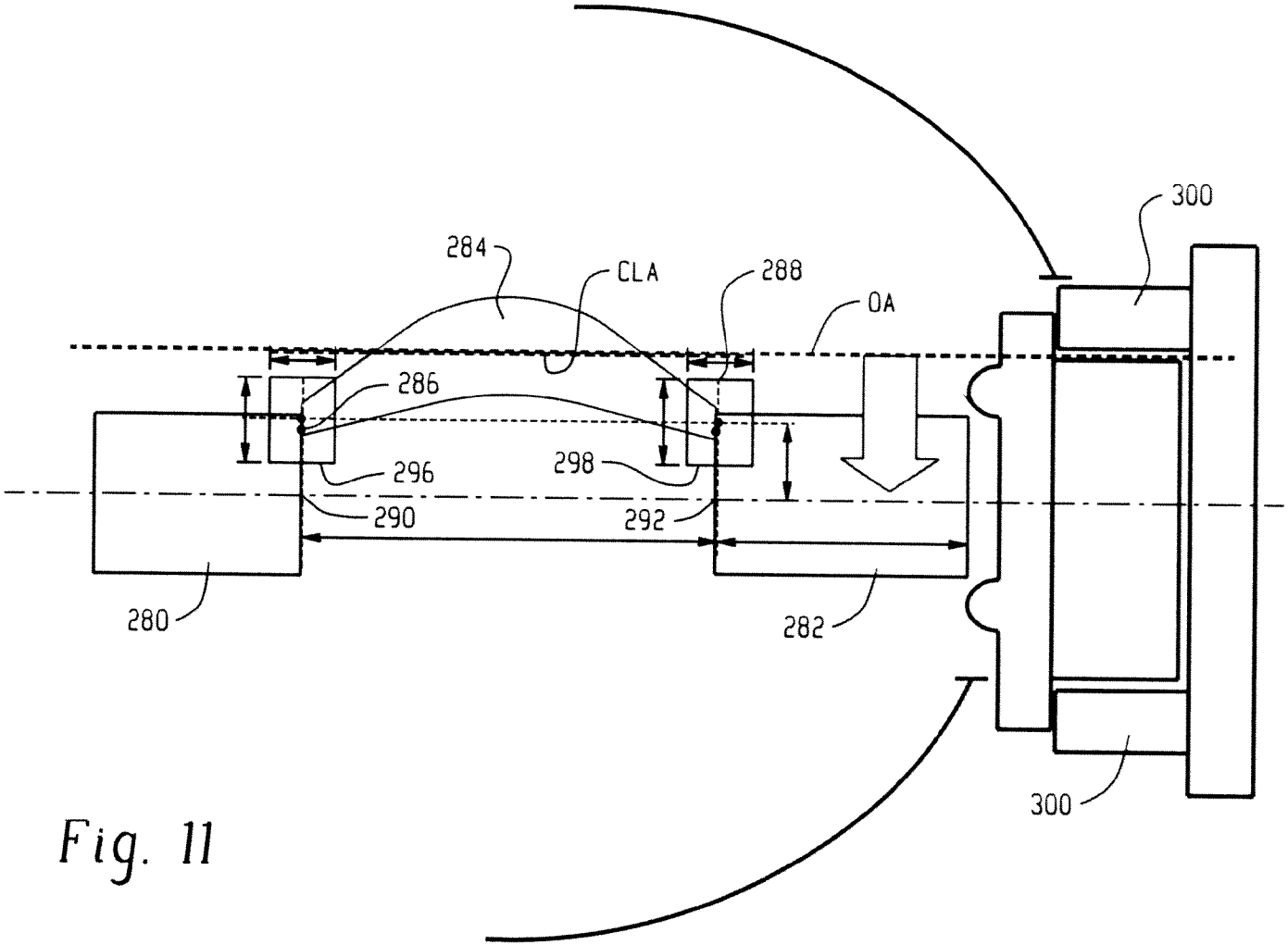
FIG. 11 shows the preferred modified alignment of the arc of a high intensity discharge lamp relative to the headlamp optics for increased light collecting efficiency of the headlamp.

This misalignment loss is further addressed by laterally displacing the lamp cap holder 300 as shown in FIG. 11. This lateral displacement of the lamp cap holder 300 relative to the optical axis OA of the headlamp optics, places the center line CLA of the arc into the optical axis OA of the headlamp optics and eliminates the arc misalignment losses of the embodiment of FIG. 9 and FIG. 10. The lateral displacement of the lamp holder section of the headlamp can be a fixed value (based on nominal values for electrode diameter and degree of arc bending), or can be adjustable such as by an alignment screw or other adjustment mechanism.

Still another improvement in arc alignment for the headlamp can be ensured by application of a more accurate lamp fixation method. For example, a precise and mechanically more robust "turn-and-secure" type of mechanical or combined mechanical and electrical fixation option built into the cap design 300 provides for better fixation and alignment of the lamp and its arc discharge, even in case of the common high intensity vibrating automotive environment. This more accurately positions the components of the headlamp to optimize light collection.

The curved mirror segment 250 on the rear surface of the cut-off shield 222, i.e., that surface that faces the engine, improves light collection efficiency of the projector type headlamp 200. If a point-like light source 202 is placed at the first focal point 204 of the generally ellipsoidal main mirror 210, then the mirror surface geometry bounces back otherwise absorbed light rays toward the light source itself. After passing the light source 202, these back reflected rays are then combined with the beam of rays that were originally launched to directions reaching the road surface at the desired points.

It is also contemplated that the mirror surface 250 could be purposefully made imperfect so that re-directed light rays will not overheat the light source 202, but will pass closely adjacent the light source and still contribute to light output from the headlamp as described above.

The curved surface of the additional mirror segments 250 and 260 on the shield 222 can be a rather complex or sophisticated shape. However, computer controlled machinery allows the manufacture of such a complex mirror surfaces. The cut-off shield 222 in a so-called bi-xenon projector headlamp system is not fixed in its position. That is, in the upright position, or "low beam" mode, of FIGS. 4, 5, and 7, the shield 222 provides the desired beam cut-off. However, as illustrated in FIGS. 6 and 8, the shield 222 is rotated or flipped in a horizontal position and moved out of the beam to form the "high beam" mode without the cut-off.

The inclusion of the curved mirror segment 250 on the shield also requires that the shield be rotated in the opposite direction from prior art arrangements. That is, in the past, the shield was flipped forward (FIG. 1), i.e., toward the lens 220, while in the new bi-xenon ellipsoidal projector module the cut-off shield 222 is flipped backwardly, i.e., away from the lens. This requires a hole or opening 262 in the bottom of the generally ellipsoidal main mirror piece. The opening 262 is dimensioned to accommodate the curved mirror 250 at the rear side of the shield that covers the opening in a "low beam" mode. In the "high beam" mode, the curved mirror is completely removed from the module by the rotation of the shield. A perfect closure of the shield 222 on the opening 260 is realized if the mirror segment 260 then covers the opening. The additional mirror segment 260 on the generally ellipsoidal main mirror piece in the flipped-down position conforms to the curvature of the substantially ellipsoidal reflector in order to maximize the collection efficiency in the "high beam" mode.

To fully maximize light collection efficiency of the new ellipsoidal projector module geometry, the auxiliary mirror segments 270, 272 of FIGS. 7 and 8 are placed at the rim section of the generally ellipsoidal main mirror. The shape of these auxiliary mirror segments 270, 272 is rather limited since no blocking or unwanted light ray back reflection is allowed when switching between the "low beam" and "high beam" modes. In a fixed "low beam" mode ellipsoidal projector module, however, the shape of these auxiliary mirrors and the rim of the main mirror and the mirror segment placed on the front surface of the cut-off shield can be harmonized.

Light collection efficiency is further improved if a lateral displacement is incorporated into the lamp holder section of the headlamp. This is best illustrated in FIGS. 10 and 11 where purposeful misalignment or lateral displacement of the lamp holder section 300 of the headlamp relative to the optical axis OA of the headlamp optics can be provided or can be adjusted by means of an alignment screw or other adjusting mechanism.

As a result, the light collection efficiency of the automotive headlamp, and thus the total light output, road illuminance levels, or projected beam angle of a projector type headlamp can be increased. This either leads to enhanced visibility of the road, or allows for application of light sources with lower power consumption. As a result, lower power consumption means better fuel efficiency for the vehicle.

The disclosure has been described with reference to the preferred embodiments. Obviously, modifications and alterations will occur to others upon reading and understanding the preceding detailed description. It is intended that the disclosure be construed as including all such modifications and alterations.

What is claimed is:

1. An automotive headlamp comprising:

a light source;

a reflector having a substantially ellipsoidal portion receiving light from the light source located generally at a first focal point of the substantially ellipsoidal portion and directing the light toward a lens; and a movable curved mirror interposed between the between the first focal point and a second focal point of the substantially ellipsoidal portion of the reflector for re-directing a portion of the light heading originally directly toward the lens back toward the reflector in a first position, and not-re-directing the portion of the light in a second position.

2. The headlamp of claim 1 further comprising a shield movably mounted relative to the reflector for movement between at least first and second positions where the shield selectively blocks a portion of the light from the light source from passing therethrough in the first position of the shield, and the shield supports the curved mirror.

3. The headlamp of claim 2 wherein the reflector has an opening that receives the curved mirror therethrough in the second position of the shield.

4. The headlamp of claim 2 wherein the shield includes an additional curved mirror segment on an opposite side of the shield for conforming to a curved surface of the reflector in the second non-blocking position of the shield.

5. The headlamp of claim 1 wherein the reflector is truncated.

6. The headlamp of claim 1 further comprising auxiliary mirror segments that extend the substantially ellipsoidal reflector surface and direct light from the light source toward the first or the second focal point of the reflector.

7. The headlamp of claim 1 wherein the light source is an arc discharge light source purposefully offset from the first focal point of the substantially ellipsoidal reflector.

8. The headlamp of claim 7 wherein the arc discharge light source is secured to the reflector via a "turn-and-secure" type mechanical fixing assembly.

9. The headlamp of claim 1 wherein the curved mirror is purposefully imperfect so that re-directed light rays do not overheat the light source.

10. The headlamp of claim 7 further comprising an adjustment member for selectively altering the offset of the arc discharge light source from the first focal point of the substantially ellipsoidal reflector.

11. The automotive headlamp of claim 1 wherein a central optical axis of the arc discharge light source is positioned in parallel and vertically below a horizontal longitudinal optical axis of the substantially ellipsoidal portion of the reflector.

12. An automotive headlamp having a projector module for "high beam" and "low beam" operation comprising:

a truncated substantially ellipsoidal reflector receiving light from the light source that is substantially located at a first focal point of the reflector and directing the light toward a projector lens where a second focal point of the reflector is interposed between the light source and the projector lens;

an arc discharge light source located generally at the first focal point of the substantially ellipsoidal reflector;

a movable shield that blocks light from the light source in the "low beam" operating condition of the headlamp;

a curved mirror extending from a first side of the shield that faces the light source for re-directing light heading originally directly toward the shield back toward the reflector in the first blocking position of the shield; and an additional curved mirror segment on a second side of the shield that conforms to the curved surface of the substantially ellipsoidal reflector when the shield is moved to a second non-blocking position.

13. The headlamp of claim 12 further comprising auxiliary mirror segments that extend the truncated substantially ellipsoidal reflector and direct light from the light source toward the first or the second focal point of the substantially ellipsoidal reflector.

14. The headlamp of claim 12 wherein a central optical axis of the arc discharge light source is positioned in parallel and vertically below a horizontal longitudinal optical axis of the substantially ellipsoidal reflector.

15. The headlamp of claim 14 further comprising an adjustment member for selectively altering the offset of the arc discharge light source from the first focal point of the substantially ellipsoidal reflector.

16. The headlamp of claim 12 wherein the curved mirror is slightly out of focus with the light source so that re-directed light rays do not overheat the light source.

17. An automotive headlamp comprising:

a light source;

a reflector having a substantially ellipsoidal portion receiving light from the light source located generally at a first focal point of the substantially ellipsoidal portion and directing the light toward a lens;

a curved mirror interposed between the between the first focal point and a second focal point of the substantially ellipsoidal portion of the reflector for re-directing a portion of the light heading originally directly toward the lens back toward the reflector; and a shield movably mounted relative to the reflector for movement between at least first and second positions where the shield selectively blocks a portion of the light from the light source from passing therethrough in the first position of the shield, and the shield supports the curved mirror.

* * * * *